United States Patent [19]

Witting et al.

[11] Patent Number: 5,057,751

[45] Date of Patent: Oct. 15, 1991

[54] PROTECTIVE COATING FOR HIGH-INTENSITY METAL HALIDE DISCHARGE LAMPS

[75] Inventors: Harald L. Witting, Burnt Hills; Svante Prochazka, Ballston Lake; Thomas B. Gorczyca, Schenectady; Jennifer L. Myers, Clifton Park, all of N.Y.

[73] Assignee: General Electric Company, Schenectady, N.Y.

[21] Appl. No.: 553,304

[22] Filed: Jul. 16, 1990

[51] Int. Cl.[5] ..... H05B 41/16

[52] U.S. Cl. ..... 315/248; 315/344; 313/635

[58] Field of Search ..... 315/248, 39, 111.21, 315/344; 313/635, 636, 553

[56] References Cited

U.S. PATENT DOCUMENTS 4,223,250 9/1980 Kramer ..... 315/248
4,574,218 3/1986 Bateman ..... 313/635
4,810,938 3/1989 Johnson et al. ..... 315/248
4,990,789 2/1991 Uesaki ..... 315/248

OTHER PUBLICATIONS

Waymouth, J. F., "Electric Discharge Lamps", MIT Press, 1971, pp. 266–277.

*Primary Examiner*—Eugene R. Laroche
*Assistant Examiner*—Amir Zarabian
*Attorney, Agent, or Firm*—Jill M. Breedlove; James C. Davis, Jr.; Marvin Snyder

[57] ABSTRACT

A protective coating of suitable composition and thickness is applied to the inner surface of the arc tube of a high-intensity, metal halide discharge lamp in order to avoid a substantial loss of the metallic component of the metal halide fill and hence a substantial buildup of free halogen, thereby extending the useful life of the lamp. A preferred lamp structure includes a fused silica arc tube with a silicon coating. The silicon coating is preferably applied to the arc tube using a chemical vapor deposition process.

12 Claims, 1 Drawing Sheet

PROTECTIVE COATING FOR HIGH-INTENSITY METAL HALIDE DISCHARGE LAMPS

RELATED APPLICATIONS

This application is related to commonly assigned U.S. Pat. application Ser. No. 553,038 of H.S. Spacil and R.H. Wilson, now allowed, and to commonly assigned U.S. Pat. application of Ser. No. 553,303, V.D. Roberts, D.A. Doughty and J.L. Myers, both applications filed concurrently herewith and incorporated by reference herein.

FIELD OF THE INVENTION

The present invention relates generally to high-intensity, metal halide discharge lamps. More particularly, the present invention relates to a protective coating for a high-intensity, metal halide discharge lamp for extending the useful life of the lamp.

BACKGROUND OF THE INVENTION

In operation of a high-intensity metal halide discharge lamp, visible radiation is emitted by the metallic component of the metal halide fill at relatively high pressure upon excitation typically caused by passage of current therethrough. One class of high-intensity, metal halide lamps comprises electrodeless lamps which generate an arc discharge by establishing a solenoidal electric field in the high-pressure gaseous lamp fill comprising the combination of a metal halide and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High-intensity, metal halide discharge lamps, such as the aforementioned electrodeless lamps, generally provide good color rendition and high efficacy in accordance with the principles of general purpose illumination. However, the lifetime of such lamps can be limited by the loss of the metallic component of the metal halide fill during lamp operation and the corresponding buildup of free halogen. In particular, the loss of the metal atoms shortens the useful life of the lamp by reducing the visible light output. Moreover, the loss of the metal atoms leads to the release of free halogen into the arc tube, which may cause arc instability and eventual arc extinction, especially in electrodeless high-intensity, metal halide discharge lamps.

The loss of the metallic component of the metal halide fill may be attributable to the electric field of the arc discharge which moves metal ions to the arc tube wall. For example, as explained in Electric Discharge Lamps by John F. Waymouth, M.I.T. Press, 1971, pp. 266–277, in a high-intensity discharge lamp containing a sodium iodide fill, sodium iodide is dissociated by the arc discharge into positive sodium ions and negative iodine ions. The positive sodium ions are driven towards the arc tube wall by the electric field of the arc discharge. Sodium ions which do not recombine with iodine ions before reaching the wall may react chemically at the wall, or they may pass through the wall and then react outside the arc tube. (Normally, there is an outer light-transmissive envelope disposed about the arc tube.) These sodium ions may react to form sodium silicate or sodium oxide by reacting with a silica arc tube or with oxygen impurities. As more and more sodium atoms are lost, light output decreases, and there is also a buildup of free iodine within the arc tube that may lead to arc instability and eventual arc extinction. Furthermore, the arc tube surface may degrade as a result of the ion bombardment. Therefore, it is desirable to prevent the loss of the metallic component of the metal: halide lamp fill and the attendant buildup of free halogen, thereby extending the useful life of the lamp.

OBJECTS OF THE INVENTION

Accordingly, an object of the present invention is to provide means for preventing a substantial loss of the metallic component of the metal halide fill of a high-intensity, metal halide discharge lamp and hence a substantial buildup of free halogen, thereby extending the useful life of the lamp.

Another object of the present invention is to provide a protective coating for the arc tube of a high-intensity, metal halide discharge lamp for preventing a substantial loss of the metallic component of the metal halide fill of a high-intensity, metal halide discharge lamp and hence a substantial buildup of free halogen.

Still another object of the present invention is to provide a method for applying a protective coating to the arc tube of a high-intensity, metal halide discharge lamp in order to prevent a substantial loss of the metallic component of the metal halide fill of a high-intensity, metal halide discharge lamp and hence a substantial buildup of free halogen.

SUMMARY OF THE INVENTION

The foregoing and other objects of the present invention are achieved in a new and improved protective coating for the arc tube of a high intensity, metal halide discharge lamp. The protective coating of the present invention is of suitable composition and thickness to prevent a substantial loss of the metallic component of the metal halide fill and hence a substantial buildup of free halogen thereby extending the useful life of the lamp. In a preferred embodiment, the protective coating comprises a layer of silicon applied to the inner surface of the arc tube, which layer is sufficiently thick to avoid a substantial loss of the metallic component of the metal halide fill, but is sufficiently thin so as to allow only minimal blockage of visible light output from the arc tube.

A preferred method for applying the protective coating to the arc tube involves a chemical vapor deposition process wherein the protective coating is initially applied to both the inner and outer surfaces of the arc tube. The outer coating is subsequently removed by immersing the arc tube in a suitable etchant.

BRIEF DESCRIPTION OF THE DRAWING

The features and advantages of the present invention will become apparent from the following detailed description of the invention when read with the sole accompanying drawing FIGURE which illustrates a high-intensity, metal halide discharge lamp employing the protective coating of the present invention.

DETAILED DESCRIPTION OF THE INVENTION

Figure 1:
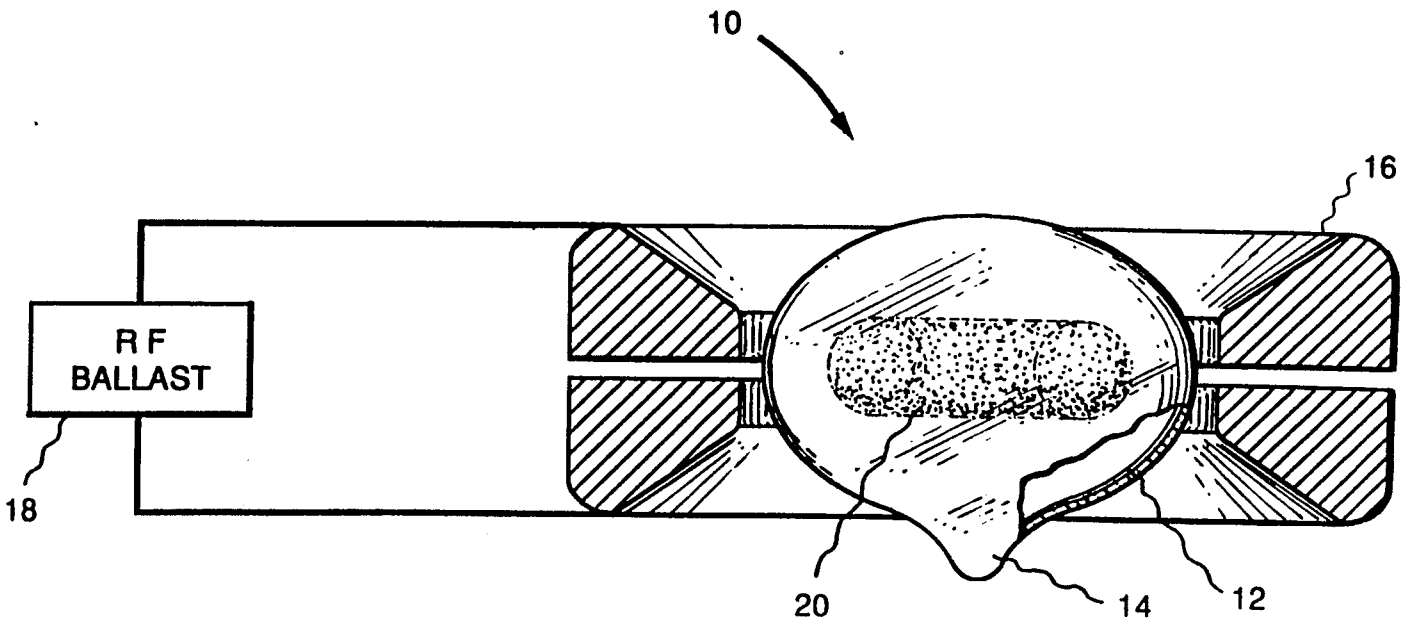

The sole drawing FIGURE illustrates a high-intensity, intensity, metal halide discharge lamp 10 employing a protective coating 12 in accordance with the present invention. For purposes of illustration, lamp 10 is shown as an electrodeless, high-intensity, metal halide discharge lamp. However, it is to be understood that the principles of the present invention apply equally well to high-intensity, metal halide discharge lamps having electrodes. As shown, electrodeless metal halide discharge lamp 10 includes an arc tube 14 formed of a high temperature glass, such as fused silica, or an optically transparent ceramic, such as polycrystalline alumina. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a metal halide fill in which a solenoidal arc discharge is excited during lamp operation. A suitable fill, described in commonly assigned U.S. Pat. No. 4,810,938 of P.D. Johnson, J.T. Dakin and J.M. Anderson, issued on Mar. 7, 1989, comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. The Johnson et al. patent is hereby incorporated by reference. Another suitable fill is U.S. Pat. No. 4,972,120 of H.L. issued Nov. 20, 1990, and assigned to the instant assignee, which patent is hereby incorporated by reference. The fill of the Witting patent comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon.

Electrical power is applied to the HID lamp by an excitation coil 16 disposed about arc tube 14 which is driven by an RF signal via a ballast 18. A suitable excitation coil 16 may comprise, for example, a two-turn coil having a configuration such as that described in commonly assigned, copending U.S. Pat. application Ser. No. 493,266, of G.A. Farrall, filed Mar. 14, 1990, now allowed, which patent application is hereby incorporated by reference. Such a coil configuration results in very high efficiency and causes only minimal blockage of light from the lamp. The overall shape of the excitation coil of the Farrall application is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J.M. Anderson, issued Mar. 14, 1989, which patent is hereby incorporated by reference. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

In accordance with the present invention, the protective coating 12 applied to the inner surface of arc tube 14 is of sufficient thickness to prevent a substantial loss of the metallic component of the metal halide fill and hence a corresponding substantial buildup of free halogen. In addition, the protective coating must be sufficiently thin to allow only minimal blockage of visible light output from the arc tube. Advantageously, since the metal component of the fill generates the visible radiation during lamp operation, the useful life of the lamp is extended by preventing a substantial loss thereof. Furthermore, since a buildup of free halogen typically causes arc instability and eventual arc extinction, preventing such a buildup likewise extends the useful life of the lamp.

In a preferred embodiment of the present invention, arc tube 14 is comprised of fused silica, and protective coating 12 comprises a layer of silicon. A preferred thickness of silicon coating 12 is between 3 and 40 nanometers, with a more preferred range being from 10 to 20 nanometers. Silicon is a preferred protective coating because it has a relatively low thermal expansion coefficient and a high melting point. In addition, silicon may be advantageously employed as a coating on fused silica arc tubes because it is chemically compatible with silica and because it reacts with oxygen impurities to form silica. Moreover, for metal halide lamps having sodium as one of the fill ingredients, silicon is a preferred coating because it is a poor solvent for sodium and does not form compounds therewith.

In another aspect of the present invention, a method for applying protective coating 12 to arc tube 14 is provided. In general, a preferred method involves a chemical vapor deposition process wherein the coating is initially applied to both the inner and outer surfaces of the arc tube. The outer coating is subsequently either removed by immersing the arc tube in a suitable etchant or it is converted to a transparent oxide by heating the sealed arc tube in air. The following example illustrates the method of the present invention as applied to two electrodeless, high-intensity, metal halide discharge lamps.

EXAMPLE

Two electrodeless, high-intensity discharge lamps, designated herein as Lamps A and B, each having a fused silica arc tube (20 mm outer diameter and 13 mm height) and an attached exhaust tube, were etched in a dilute HF solution, rinsed in de-ionized water and then heated to 1100° C. in a dry oxygen/chlorine ambient at atmospheric pressure. After cooling, the arc tubes were placed in a low-pressure chemical vapor deposition tube, wherein they were heated to 625° C. under vacuum conditions, and then exposed to an ambient of silicon hydride ($SiH_4$) gas at 300 mtorr for 1.5 min. As a result, a 15 nanometer thick silicon layer was deposited on both the inner and outer surfaces of each arc tube. The outer silicon coatings were then removed by immersing the arc tubes for 30 seconds in an etchant solution composed of 5 parts $HNO_3$, 5 parts acetic acid, 2 parts HF, and 5 parts water. After rinsing and drying, the arc tubes were heated at 915° C. for 30 minutes in an ambient of 300 mtorr nitrous oxide. The arc tubes were then filled with sodium iodide (4.75 mg) and cerium iodide (2.25 mg), after which the arc tubes were sealed onto a vacuum system, exhausted, outgassed, then filled with krypton at 250 torr, and finally sealed.

Lamps A and B were each operated on a life test using a 250 Watt, RF power supply at 13.56 MHz which delivered current to a two-turn excitation coil surrounding the arc tubes. The lamps were periodically removed from the life test to measure the light output and the level of free iodine. The level of free iodine was monitored in each lamp by measuring the optical absorption at a wavelength of 520 nm. The measured iodine levels in both Lamps A and B did not exceed 0.05 mg throughout life tests of 1600 and 2600 hours, respectively. These levels were compared with those of arc tubes previously made without silicon coatings, but operated in the same way, which exhibited free iodine levels of 0.17 mg iodine at 1600 hours and more than 0.20 mg at 2600 hours. Moreover, while the arc tubes that were not coated with silicon exhibited increasing levels of free iodine that led to arc instability and eventual arc extinction, the coated arc tubes did not exhibit increasing levels of free iodine, but maintained substantially the same level throughout the life tests.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A high intensity discharge lamp, comprising:

a light-transmissive arc tube for containing a plasma arc discharge;

a fill disposed in said arc tube, said fill including at least one metal halide;

excitation means for coupling electrical power to said fill for exciting said arc discharge therein; and a protective silicon coating disposed on the inner surface of said arc tube of sufficient thickness to prevent a substantial loss of the metal component of said fill and a corresponding substantial buildup of free halogen in said arc tube.

2. The lamp of claim 1 wherein said arc tube is comprised of fused silica.

3. The lamp of claim 1 wherein the thickness of said protective silicon coating is in the range from approximately 3 to 40 nanometers.

4. The lamp of claim 3 wherein the thickness of said protective silicon coating is in the range from approximately 10 to 20 nanometers.

5. An electrodeless high intensity discharge lamp, comprising:

a light-transmissive arc tube for containing a plasma arc discharge;

a fill disposed in said arc tube, said fill including at least one metal halide;

an excitation coil disposed about said arc tube and adapted to be coupled to a radio frequency power supply for exciting said arc discharge in said fill; and a protective silicon coating disposed on the inner surface of said arc tube of sufficient thickness to prevent a substantial loss of the metal component of said fill and a corresponding substantial buildup of free halogen in said arc tube.

6. The lamp of claim 5 wherein said arc tube is comprised of fused silica.

7. The lamp of claim 5 wherein the thickness of said protective silicon coating is in the range from approximately 3 to 40 nanometers.

8. The lamp of claim 7 wherein the thickness of said protective silicon coating is in the range from approximately 10 to 20 nanometers.

9. A method for manufacturing an electrodeless, high-intensity, metal halide discharge lamp having an arc tube for containing a plasma arc discharge, comprising the steps of:

applying a silicon coating to the inner surface of said arc tube;

filling said arc tube with a fill including at least one metal halide;

adding a buffer gas to said fill; and sealing said arc tube.

10. The method of claim 9 wherein said step of applying said silicon coating comprises:

enclosing said arc tube in a chemical vapor deposition container;

decomposing silicon hydride at a sufficiently high temperature in said container so that a layer of silicon forms on the inner and outer surfaces of said arc tube; and removing the layer of silicon from the outer surface of said arc tube.

11. The method of claim 10 wherein said step of removing the layer of silicon from the outer surface of said arc tube comprises immersing said arc tube in an etchant.

12. The method of claim 9 wherein said step of applying said silicon coating comprises:

enclosing said arc tube in a chemical vapor deposition container;

decomposing silicon hydride at a sufficiently high temperature in said container so that a layer of silicon forms on the inner and outer surfaces of said arc tube; and heating said arc tube in the presence of air so as to convert the layer of silicon on the outer surface thereof to a substantially transparent layer of silica.

* * * * *